US006164083A

United States Patent [19]

Leeming et al.

[11] Patent Number: 6,164,083

[45] Date of Patent: Dec. 26, 2000

[54] LIQUID TEMPERATURE REGULATING APPARATUS

[75] Inventors: Douglas Richard Leeming, Chesterfield; Brian John Colin Brown, Eastleigh, both of United Kingdom

[73] Assignee: Eventemp Limited, Derbyshire, United Kingdom

[21] Appl. No.: 09/117,238

[22] PCT Filed: Feb. 3, 1997

[86] PCT No.: PCT/GB97/00288

§ 371 Date: Oct. 21, 1998

§ 102(e) Date: Oct. 21, 1998

[87] PCT Pub. No.: WO97/28082

PCT Pub. Date: Aug. 7, 1997

[30] Foreign Application Priority Data

Feb. 1, 1996 [GB] United Kingdom ..... 9601994

[51] Int. Cl.[7] ..... B67D 5/62

[52] U.S. Cl. ..... 62/393; 62/201; 62/389; 222/146.6

[58] Field of Search ..... 62/389, 390, 391, 62/393, 394, 396, 399, 201; 222/1, 146.6

[56] References Cited

U.S. PATENT DOCUMENTS

| | | | |
|---|---|---|---|
| 2,248,637 | 7/1941 | McLaughlin | 62/7 |
| 2,646,667 | 7/1953 | Kromer | 62/116 |
| 2,678,549 | 5/1954 | Campbell et al. | 62/141 |
| 3,283,530 | 11/1966 | Bayne et al. | 62/389 |
| 4,094,445 | 6/1978 | Bevan | 222/1 |
| 4,216,879 | 8/1980 | McMillin | 222/1 |
| 4,625,525 | 12/1986 | Bradbury et al. | 62/330 |
| 4,676,400 | 6/1987 | Lamont et al. | 222/1 |
| 4,679,408 | 7/1987 | Nelson | 62/390 |
| 5,502,978 | 4/1996 | Field | 62/157 |
| 5,873,259 | 2/1999 | Spillman | 62/396 |

FOREIGN PATENT DOCUMENTS

| | | |
|---|---|---|
| 0152283 | 8/1985 | European Pat. Off. . |
| 2232400A | 12/1990 | United Kingdom . |

*Primary Examiner*—Henry Bennett
*Assistant Examiner*—Marc Norman
*Attorney, Agent, or Firm*—Fish & Richardson PC

[57] ABSTRACT

A liquid temperature apparatus is used in a beverage dispensing system comprising a beverage storage container connected via a liquid feed tube to a liquid dispense tap. The liquid feed tube is divided by a Tee piece and connected to a pair of circulation tubes. A pump means circulates the beverage around the tubes, and also around the coil of the cooling unit. The fluid flow rate is controlled by the adjustable fluid control device.

10 Claims, 4 Drawing Sheets

LIQUID TEMPERATURE REGULATING APPARATUS

This invention relates to liquid temperature regulating apparatus, and more particularly to a liquid temperature regulating apparatus and method suitable for use in beverage dispensing devices whereby potable liquids are dispensed at pre-determined temperatures.

In the beverage dispensing industry, when beverages are not dispensed directly from the container, a system of pipe work or tubing is used to transfer the product from its bulk storage area to a convenient point of service. Such dispense tubes, pipes or lines are used today extensively for the serving of beers, ciders, soft drinks and other beverages in public houses, bars and other licensed premises.

The pipework or tubing was originally formed from, for example, a variety of metals, rubber, glass and ceramics materials. With the advent of modern hygienic flexible plastics tubing and pipework, the installation of the pipework or tubing has become simplified.

Customer demand over recent years has led to the development of various methods of cooling the products to suit various tastes and climatic conditions. Wherever possible, bulk potable liquids are stored at near ideal drinking temperatures, but problems still arise during the movement of the potable liquids from a cool storage area to a dispensing point, because of undesirable temperature rises of the liquid in the dispense tube, pipe or line.

In the prior art, two methods of dealing with this problem have been adopted:

(i) In the first method, a "flash" cooler is mounted as close as possible to the point of dispense. As the beverage is drawn off through, for example, a tap or faucet, it is introduced into a metal tubular coil immersed in a bath of refrigerated liquid. It is, however, difficult to maintain a constant temperature, because, should the beverage remain in the coil for long periods, it will be below the recommended temperature, and on rapid constant delivery, the coil has difficulty in liberating sufficient heat from the beverage. A further undesirable feature of the flash cooler is that the refrigerator apparatus gives off copious amounts of heat in and around the servery which is uncomfortable for the staff of the premises in certain climatic conditions.

(ii) In the second method, a "python" line chilling device extending from the cool storage area to close to the point of dispense is used. The python device consists of several product delivery tubes or pipes encapsulated together with two larger diameter flexible tubes, one for flow and the other for return, the whole being wrapped with an insulating material to prevent heat ingress. The flow and return tubes constantly circulate a coolant fluid, usually water, from a remotely mounted refrigerated cooler. Although temperature control is more readily maintained in comparison with the flash cooling method, after a time, even those product lines furthest away from the flow and return tubes become too cold, rendering cask conditioned beers flat, leading to unattractive presentation, loss of vital flavours and lack of detection of high temperature vaporising odours. The recently introduced range of "ice" beers, which are served at very low temperatures, compounds the problem even further. In addition, the inflexibility, size and bulk of the python lines make their installation difficult and time consuming. The python system, containing as it usually does, a variety of product lines that ideally should be served at differing temperatures, has the further disadvantage that, the correct dispense temperature of various and varying beverages cannot always be maintained to the manufacturer's preferred recommended temperature.

(iii) U.S. Pat. No. 4,216,879 discloses another arrangement in which carbonated water is circulated by a pump around a ring main in which is disposed a refrigeration unit so that the water in the ring main is cooled and kept at a constant temperature. The ring main can have a number of dispensing taps off it. However, the refrigeration unit must be capable of coping with peak demand from the dispensing taps and hence must be a substantial unit.

It will be appreciated that there is a need for an improved apparatus and method for controlling and monitoring the temperature of beverages within dispense tubes, pipes or lines.

In accordance with the present invention, there is provided a potable liquid temperature regulating apparatus comprising a liquid container, a feed tube, a refrigeration unit, a ring main comprising a pump and a plurality of dispense taps, and a further refrigeration unit in the ring main, wherein the pump circulates the liquid in the ring main independently of the dispense taps.

With this arrangement the further refrigeration unit need only have sufficient heat absorbing capacity to keep the beverage circulating in the ring main at the right temperature. The first refrigeration unit provides the bulk cooling so that during periods of high demand at the dispensing taps, the cooling capacity of the further refrigeration unit is never exceeded, given that the change in temperature of the beverage during high demand is kept low because of the first unit.

Preferably, means are provided for over-riding the action of the pump when liquid is dispensed from the liquid dispense taps. Indeed, fluid flow control means may be provided to control the liquid flow rate of the circulating liquid in the ring main. The fluid control means may comprise at least one of either a restriction allowing flow of the potable liquid at a predeterminable rate restricted relative to the flow capacity of the ring main or an on/off valve for allowing or preventing flow of the potable liquid.

Preferably, there is provided a temperature sensor and wherein the fluid control means is responsive to a predeterminable signal from the temperature sensor to vary the rate of flow of the potable liquid.

Alternatively, or in addition, the fluid control means may be responsive to an actuation, such as opening, one or more of the dispense taps.

In conventional cooling systems, yeast deposits often build up in the tubes carrying the potable liquid from bulk storage to the point of dispense. Typically, beverage cooling systems comprise a refrigerated bulk storage and a possible solution to regulation of the temperature of the potable liquid is to recirculate via the refrigerated bulk storage. However, such a solution is neither hygienic nor, in many jurisdictions, legal.

Accordingly, the present invention provides a potable liquid temperature regulating apparatus, wherein the potable liquid is brought into contact with the liquid temperature regulating means without being returned to bulk of the potable liquid.

The liquid temperature regulating apparatus of the invention is suitable for use with any appropriate beverage dispensing system, but is particularly useful in the dispensing of beverages which need to be served at or below ambient temperatures, particularly below 15° C., and especially from 0 to 13° C., for example, from about 8 to 12° C.

The invention is applicable to the dispensing of a wide range of beverages, for example beers, lagers, ciders, wines and soft drinks. The invention is, however, particularly suitable for use in the dispensing of beers and lagers, where temperature control at the point of delivery is particularly important.

The liquid storage means can be any of those conventionally used, and will normally comprise a keg, barrel, or other storage container, situated remotely from the dispensing means in a cellar or storeroom.

The dispensing means can comprise, for example, a tap or faucet, a beer pump, or any similar such device.

The liquid dispense tube, pipe, or line extends from the liquid storage means to the dispensing means, and can comprise, for example, one or more such tubes, pipes, or lines made from, for example, a suitable flexible plastics material.

In a preferred embodiment of the invention, the liquid dispense tube, pipe, or line comprises two such tubes, pipes, or lines located within an outer insulated jacket formed from, for example, a suitable foam material. Preferably the two tubes, pipes, or lines are connected at their ends, for example, by Y- or Tee piece connectors so that they run in parallel for at least a part of the tube, pipe, or line extending from the liquid storage means to the liquid dispensing means. The two tubes are arranged to provide flow and return beverage paths in to order to facilitate circulation of the beverage. However, the flow and return paths can equally well be realised using a single tube with appropriate taps being taken therefrom to allow dispensing of the potable liquid.

The refrigeration units can comprise, for example, a conventional beverage cooler having a reservoir of cooling fluid and one or more cooling coils within which one or more beverages can flow. Preferably, however, the refrigeration units comprise a cooler provided with a plurality of cooler compartments arranged at different temperatures or provided with a single cooling compartment having a temperature gradient, so that beverages in a plurality of different cooling coils are exposed to different temperatures in the cooler.

The temperature of the liquid circulating in the ring main will be dependent upon the temperature of the further refrigeration unit, the residence time of the liquid in contact with the further refrigeration unit, and the liquid flow rate. The liquid flow rate may be regulated by altering the speed of the pump or by the use of a flow control device.

It is important not to leave stagnant areas in the circuit, and appropriate flow control and equalising devices can be provided as necessary.

Preferably, once a liquid dispensing tap is operated, the liquid in the dispense tubes, pipes or lines flows and allows the liquid to be dispensed. At the same time, further liquid beverage from the bulk container enters the feed tubes, pipes or lines, and, on closure of the dispensing means the circulation of liquid beverage around the system can continue. Preferably the pump means is of the type whose action can be over-ridden by the liquid dispense flow. Alternatively the pump means can be provided with an override valve, or bypass, or the like.

Any number of liquid dispense tubes, pipes or lines can be used as desired, and any suitable configurations for re-circulation flow and return can be provided as required. The invention allows the possibility of using liquid dispense tubes, pipes or lines of a much smaller diameter than those usually employed.

In preferred embodiment in the invention, there may be provided a beverage dispensing apparatus comprising a liquid temperature regulating apparatus wherein the beverage dispense tube, pipe or line comprises a twin flow and return tube suitably lagged or thermally insulated, a Y- or Tee piece connecting the tubes at the point of dispense, and a further Y- or Tee piece connecting the tubes at a convenient distance from the bulk container. A pump is connected in series with one of the twin tubes in order to circulate and re-circulate the beverage around the system and into contact with a refrigerated unit which is connected in parallel with the pump. The flow of the beverage in this circulating system can be controlled by the speed of the pump. Preferably a fluid flow control valve is used in order to equalise to some extent the flow through the tubes when the dispense value Is opened. Depending on the type of pump used, it may not be necessary to stop the circulating pump during dispensing. On closing the dispense valve, the flow stops, and commencement of re-circulation occurs, maintaining a constant temperature of the beverage within the dispense tubes.

The invention provides the opportunity to obtain the optimum dispense temperature for any particular beverage product. In addition, the continuous re-circulation action can also have the effect of scrubbing the internal walls of the beverage dispense tubes, pipes or lines, thus reducing the opportunity for yeast deposits to form. By dramatically reducing yeast growth within the dispense tubes, pipes or lines,, product presentation is improved and costly ullage is reduced.

An embodiment of a liquid temperature regulating apparatus of the invention will now be more particularly described, by way of example only, with reference to the accompanying Drawings in which.

Figure 1:
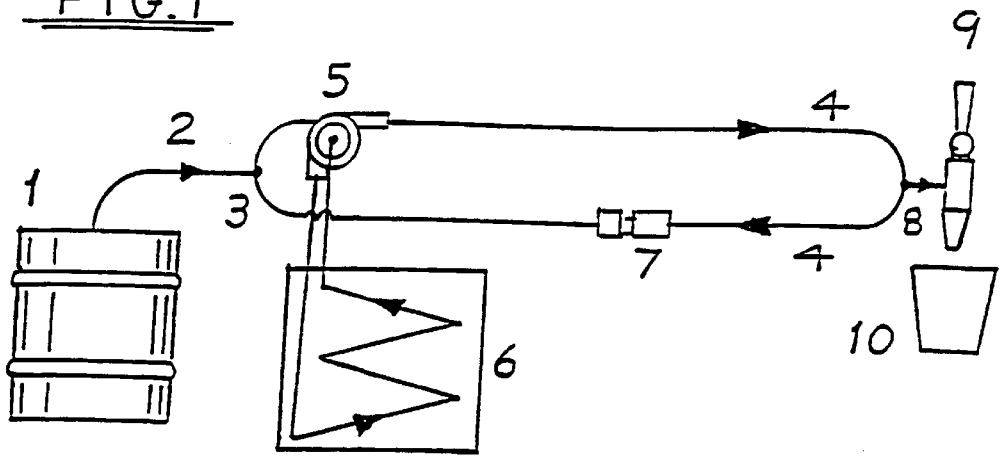
FIG. 1 shows a schematic view of a beverage dispensing system comprising a liquid temperature regulating apparatus, with the dispensing valve in its closed position.

Referring firstly to FIG. 1, there is illustrated a beverage storage container 1 connected via a liquid feed tube 2 to a liquid dispense tap 9. The liquid feed tube 2 is divided by Tee piece 3 and connected to a pair of circulation tubes 4. A pump means 5 circulates the beverage around the tubes 4, and also around the coil of the cooling unit 6, as illustrated by the arrows in FIG. 1. The fluid flow rate is controlled by the adjustable fluid control device 7.

The re-circulation tubes 4 are connected to a second Tee piece 8 which leads to the dispense tap 9.

It should be emphasised that, with the dispense tap 9 in its closed position, no flow from the container 1 takes place, as the feed to the Tee piece 3 and the liquid in tubes 4 are under equal pressure. Whilst the dispense tap 9 is closed, the pump 5 continues to circulate and re-circulate the beverage around the tubes 4, and around the cooling coil of the cooling unit 6, thus maintaining the manufacturer's recommended dispense temperature.

Figure 2:
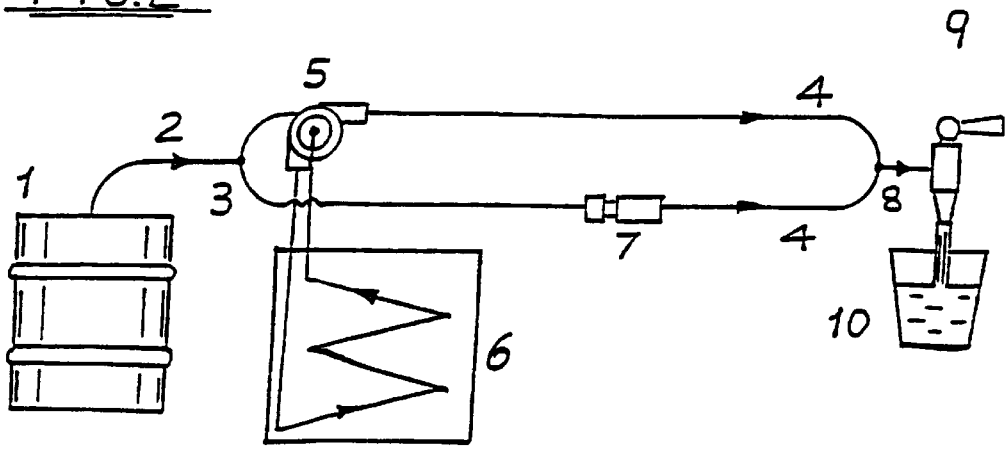
FIG. 2 shows a schematic view of the system of FIG. 1 with the dispensing valve in its open position.

Referring now to FIG. 2, there is shown the situation when the dispense tap 9 is opened and beverage flows into the receptacle 10.

It can be seen that when the tap 9 is open beverage flows along the feed line 2, and along the re-circulating tubes 4, through the second Tee piece 8 and into the dispense tap 9. Although not essential, it may be preferable to provide some means to override the pump 5 when dispensing the beverage through the dispense tap 9.

Figure 3:
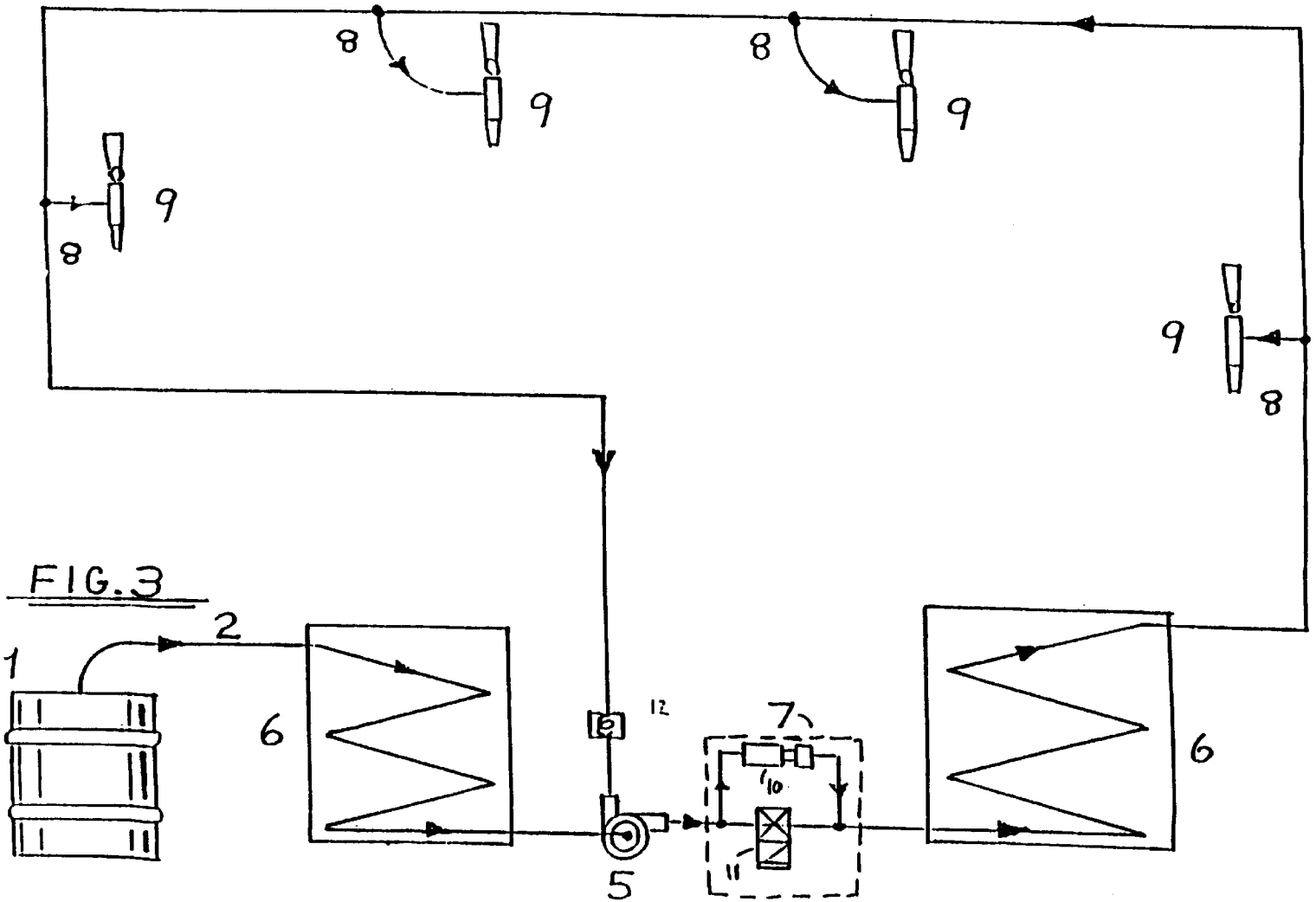
FIG. 3 shows a schematic view of an embodiment of the present invention.

With reference to FIG. 3, an embodiment is show in which the beverage or potable liquid container 1 is connected via a liquid feed tube 2 to a refrigeration or cooling unit 6. A ring main comprising a pump 5 and a plurality of dispense taps is provided for distribution of the beverage. The ring main also comprises a further cooling unit 6 for use in regulating the temperature of the beverage contained within the ring main.

The first cooling unit is typically remote from the point of dispense and is often a gycol based refrigeration unit having a very high cooling capacity. Therefore, the liquid leaving the first refrigeration unit is always at a desired temperature. During periods of high demand, the cooling capacity of the second refrigeration unit is never exceeded, as the change is temperature of the potable liquid during high demand is kept as low as possible due to the operation of the first cooling unit.

The ring main includes an adjustable fluid flow control device 7. The temperature of the beverage is regulated by varying the rate of flow of the beverage through the cooling unit 6. The fluid flow control device 7 comprises a restriction 10 which, according to an embodiment, is arranged to allow continuous restricted circulation of beverage around the ring main. The fluid flow control device also comprises an on/off 11 valve which is responsive to a temperature sensor 12. The on/off valve 11 upon actuation by the temperature sensor allows unrestricted flow of the beverage around the ring main.

The temperature sensor 12, restriction 10 and the on/off valve 11 co-operate to regulate the temperature of the beverage taking into account the rate of transfer of heat between the beverage and the refrigerant of the cooling unit which includes the temperature gradient between the beverage and the refrigerant, the rate of flow of the beverage, and hence the duration for which a given quantity of beverage is contained within the cooling unit 6, and the capacity or volume of the tubes 4 of the ring main contained within the cooling unit 6.

The regulation of the temperature of the beverage is also responsive to actuation of the dispense taps 9. Demand for beverage should be balanced against the temperature of the potable liquid. An embodiment can be realised in which the on/off valve is also made responsive to actuation or opening of a dispense tap to open the on/off valve and allow flow of potable liquid therethrough. In the event of conflicting commands being imposed upon the on/off valve, the open command in response to the dispense tap is typically arranged to take priority.

Figure 4:
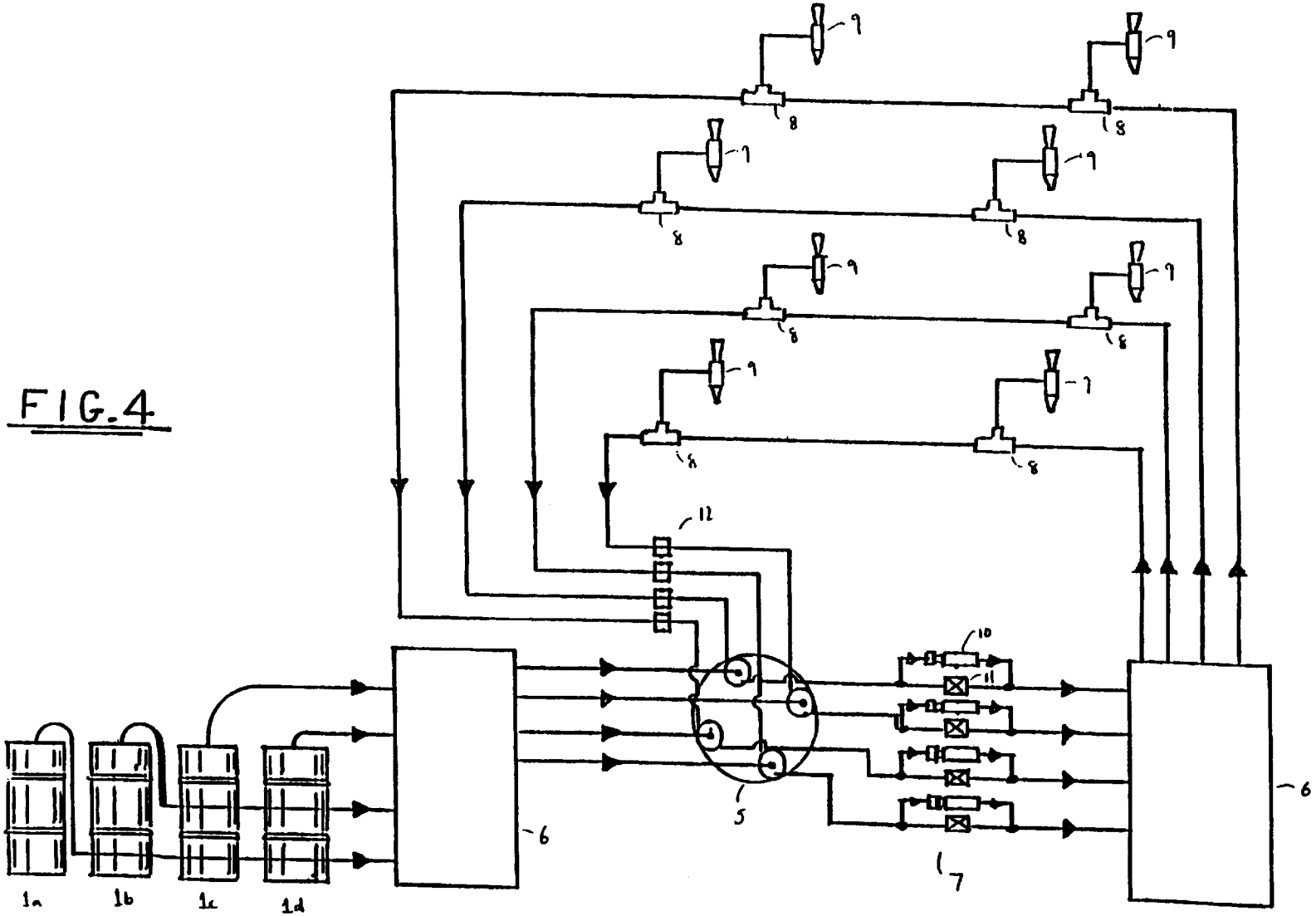
FIG. 4 shows a schematic embodiment for regulating the temperature of a plurality of potable liquids.

Referring to FIG. 4 there is shown an embodiment for regulating the temperature of a plurality of potable liquids. The beverages are stored in respective storage containers 1*a*, 1*b*, 1*c* and 1*d* and circulate around and are dispensed from respective ring mains in a manner substantially as described above in relation to FIG. 3. The pump 5 is a commonly driven electrical multi-headed pump.

Figure 5:
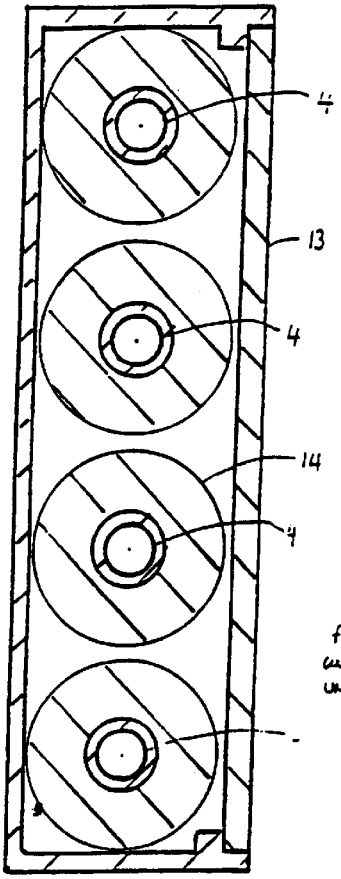
FIG. 5 shows schematically an embodiment in which the plurality of tubes are grouped together.

FIG. 5 illustrates an arrangement whereby the tubes 4 of the embodiment of FIG. 4 carrying the potable liquid are contained within a housing 13 or protective conduit. The tubes 4 are lagged or thermally insulated according to the environment with a suitable insulation material 14. The housing has a dual purpose. Firstly, the housing 13 protects the pipes against attack by pests and vermin. Secondly, the combination of the insulation 14 and the housing 13 prevent or reduce the formation of condensation on the tubes 4 carrying the potable liquid.

Figure 6:
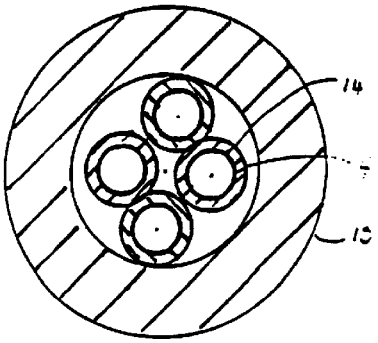
FIG. 6 shows an alternative grouping of the beverage tubes.

An alternative form of protecting the tubes 4 and preventing the formation of condensation thereon is shown in FIG. 6. The tubes 4 together with associated insulation 14 are housed within a flexible conduit 15. The flexible conduit 15 is used to accommodate changes in direction of the tubes 4 between the bulk storage and the point of dispense.

Figure 7:
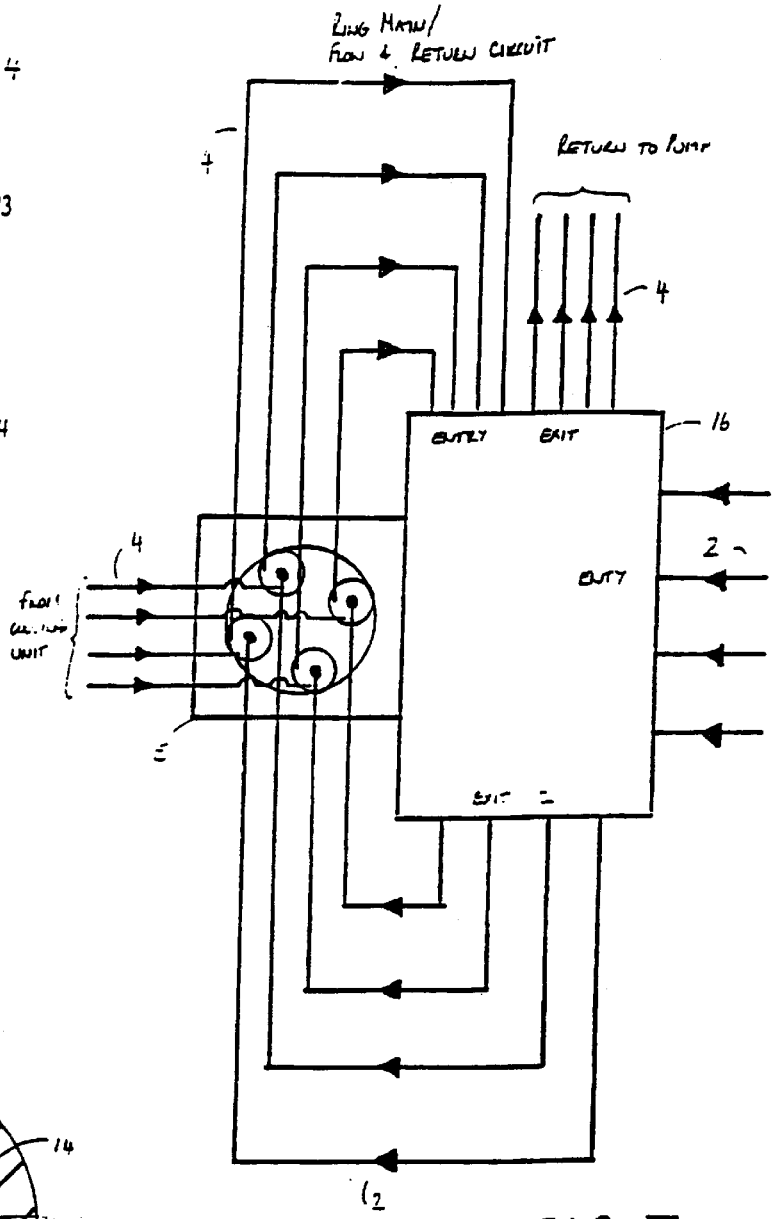
FIG. 7 shows a schematic embodiment in which the two refrigeration units of figure of FIG. 3 are combined into a single unit.

Referring to FIG. 7, there is shown an embodiment of the present invention wherein the two cooling units 6 depicted in FIGS. 3 and 4 are combined into a single unit cooling unit 16. The potable liquid passes through the cooling unit 16 twice.

The advantage of the embodiment depicted in FIG. 7 is particularly suitable for retrofitting within existing liquid refrigeration and dispense installations. The flow control device and temperature sensors are also utilised notwithstanding there absence from FIG. 7. The potable liquid comes from bulk storage and enters the cooling unit 16 from the right-hand side via tubes 2. The potable liquid is firstly cooled by the cooling unit 16 before circulation around the dispensing main or before dispense from the flow and return arrangement shown in FIGS. 1 and 2. The cooled potable liquid leaves the cooling unit via those tubes 4 in communication with the pump 5 at the bottom of FIG. 7.

The combination of the temperature sensor and fluid flow control means is operable to vary the speed and manner of flow of the potable liquid, that is to say, the rate of flow of liquid can be increased, decreased, stopped and/or started or pulsated.

Once the potable liquid reaches the pump 5 it is circulated around the ring main or flow and return tubes to which the dispense taps (not shown) are connected. The potable liquid is maintained at the desired temperature in a manner substantially as described above in relation to FIGS. 1, 2, 3 and 4. The potable liquid is then fed back to the pump 5 for further circulation.

It will be appreciated that the potable liquid is maintained at a preferred serving temperature without having to return the liquid to bulk storage which overcomes the limitations and illegalities of some prior art systems.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiments. The invention extends to any novel one, or any novel combination, of the features disclosed in this specification (including any accompanying claims, abstract and drawings), or to any novel one, or any novel combination, of the steps of any method or process so disclosed.

What is claimed is:

1. A draft beverage temperature regulating apparatus comprising:

a draft beverage container;

a feed tube;

a first refrigeration unit;

a ring main comprising a pump and a plurality of dispense taps; and a second refrigeration unit in the ring main, wherein the pump circulates draft beverage in the ring main independent of the dispense taps.

2. The draft beverage temperature regulating apparatus of claim 1 further comprising means for overriding a pump action as draft beverage is dispensed from the dispense taps.

3. The draft beverage temperature regulating apparatus of claim 2 further comprising fluid flow control means for controlling a draft beverage flow rate of the circulating draft beverage in the ring main.

4. The draft beverage temperature regulating apparatus of claim 3, wherein the fluid flow control means comprises a restrictor allowing flow of a draft beverage at a predeterminable rate that is restricted relative to a flow capacity of the ring main.

5. The draft beverage temperature regulating apparatus of claim 4, further comprising a temperature sensor, wherein the restrictor is adapted to respond to a predeterminable signal from the temperature sensor to vary the flow rate of the draft beverage.

6. The draft beverage temperature regulating apparatus of claim 5, wherein the restrictor is adapted to respond to opening one or more of the dispense taps.

7. The draft beverage temperature regulating apparatus of claim 6, wherein the on/off valve is adapted to respond to actuation of one or more of the dispense taps.

8. The draft beverage temperature regulating apparatus of claim 7, wherein actuation of the on/off valve takes priority over actuation of the dispense taps and any conflicting operation or command given to the on/off valve.

9. The draft beverage temperature regulating apparatus of claim 1, wherein the first or second refrigeration unit comprises different compartments of a single refrigeration unit.

10. The draft beverage temperature regulating apparatus of claim 3, wherein the fluid flow control means comprises an on/off valve for allowing or preventing flow of a draft beverage.

* * * * *